United States Patent [19]

Cummings

[11] Patent Number: 4,496,044

[45] Date of Patent: Jan. 29, 1985

[54] FLEXIBLE COVERING SUPPORT BRACKET

[76] Inventor: Charles M. Cummings, 156 Winthrop St., Watertown, N.Y. 13601

[21] Appl. No.: 524,672

[22] Filed: Aug. 19, 1983

[51] Int. Cl.[3] ..... B65D 65/16

[52] U.S. Cl. ..... 206/45.33; 206/45.32

[58] Field of Search ..... 220/200; 206/45.32, 206/45.33; 426/110, 124

[56] References Cited

U.S. PATENT DOCUMENTS

| | | | |
|---|---|---|---|
| 2,106,425 | 1/1938 | Grant | 206/45.33 |
| 2,206,635 | 7/1940 | Hays et al. | 206/45.32 |
| 3,286,824 | 11/1966 | Rosenthal | 206/45.33 |

*Primary Examiner*—George T. Hall

*Attorney, Agent, or Firm*—Wenderoth, Lind & Ponack

[57] ABSTRACT

An arrangement for covering the contents of a container with a flexible sheet without contacting the surface thereof, which includes a support bracket formed from an elongated resilient wire or plastic strip, having U-shaped end portions for engaging opposite top edges of the container and an elongated generally horizontally extending resilient portion bowed upward between the U-shaped end portions for supporting thereabove the flexible sheet. If the container has appropriately spaced parallel upper flanges, a support bracket may be mounted thereon by sliding the U-shaped end portions along the flanges. For somewhat larger containers, the elongated portion of the support bracket is sufficiently resilient and flexible to permit the U-shaped end portions to engage the opposite edges of the container under the inward tension of the bowed upward portion.

21 Claims, 8 Drawing Figures

FIG. 5.
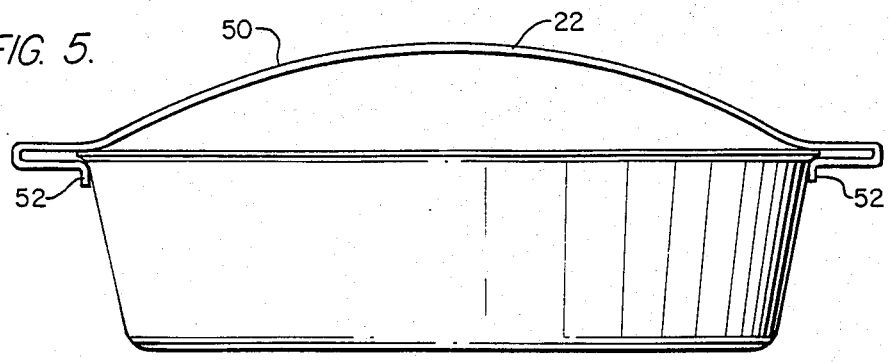
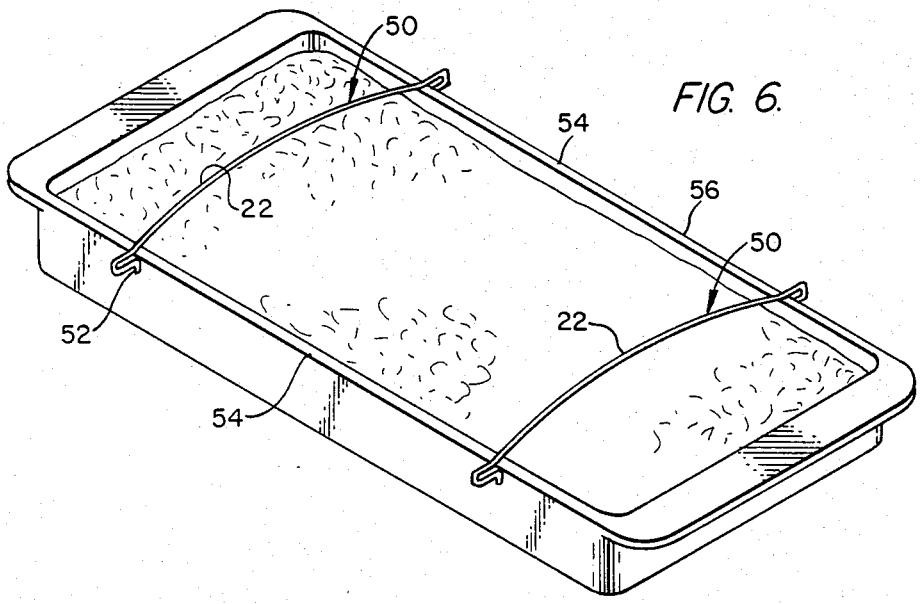
FIG. 6.
FIG. 7.
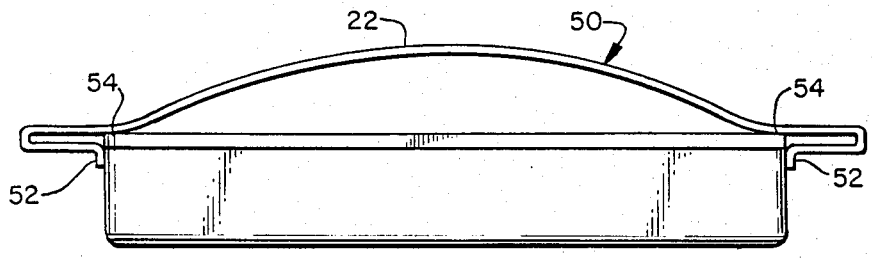
FIG. 8.
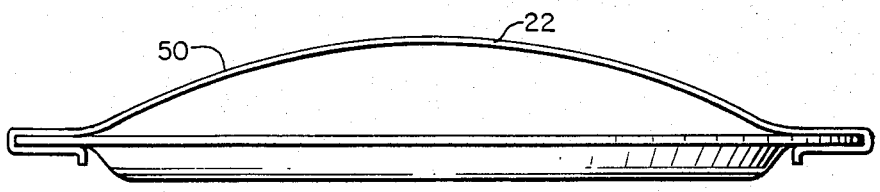

FLEXIBLE COVERING SUPPORT BRACKET

BACKGROUND OF THE INVENTION

1. Field of the Invention

The invention relates generally to flexible coverings, such as aluminum foil and plastic wrap for items, typically food, having a soft upper surface, such as cakes covered with frosting, casseroles, etc., and more particularly to a device which protects such surfaces from contact with such flexible coverings.

2. Prior Art

It is quite usual in the home to store freshly prepared food items such as cakes, casseroles and other baked items, salads and food platters in a dish or on a platter with a flexible wrapping covering the top to preserve freshness. Many such food items have soft and/or sticky upper surfaces.

When a flexible covering is placed directly over a soft or sticky surface of a food item, contact between the covering and the food surface is likely to damage the food's appearance. For example, frosting on a cake or tomato sauce on baked fish may be smeared, and cheese on a casserole may stick to the covering. In order to avoid this problem it has been common to vertically insert many toothpicks into the top of the food items and then wrap the covering over the toothpicks which keep the covering from contacting the food. However, this technique is quite time consuming and delicate, can result in holes in the covering, is effective only when the food can adequately support the toothpicks and, of course, results in holes being formed therein. Furthermore, a supply of toothpicks must be available.

OBJECTS OF THE INVENTION

It is an object of the present invention to overcome the problems and disadvantages of the prior art by providing a simple, inexpensive device which easily fastens to a container such as a baking dish or the like which keeps a flexible covering wrapped thereover from contacting the exposed surface of a food item in the dish, and which itself does not contact the food item.

It is another object of the invention to provide such a device which is easily and effectively fastened to a variety of baking dish and pan types, and which can often remain thereon while portions of the food are being removed and which can be easily removed as well.

SUMMARY OF THE INVENTION

These objects are met by the invention whose principal component is an elongated resilient member such as a wire or plastic strip having U-shaped end portions for engaging opposite top edges of a container, lying in a vertical plane, and an elongated generally horizontally extending resilient portion which is bowed upward between the U-shaped end portions for supporting thereabove a flexible sheet such as aluminum foil or plastic wrap. If the container is rectangular and has horizontal side flanges along opposite top edges of the container, the support bracket may be sized in relation to the container so that the U-shaped end portions can slide over horizontal flanges of the container. If the horizontal length of the support bracket is somewhat shorter than the distance between the opposite top edges of the container, then the support bracket can be engaged to nonrectangular as well as rectangular containers by pulling the U-shaped end portions apart sufficiently so as to engage the top edges of the container. In other words, the support bracket can be resiliently flattened somewhat in order to allow the U-shaped end portions to engage the opposite top edges of the container, whereby the U-shaped end portions are urged inwardly by tension in the bowed upward portion. When the support bracket is so slid over or engaged to the container, the foil or wrap can be draped over the support bracket out of contact with the contents of the container and crimped or stuck to the side walls or flanged upper edges of the container.

In accordance with another aspect of the invention, vertical legs are formed at the inner lower ends of the U-shaped end portions of the support bracket so as to be frictionally engagable with the side walls of the container. With this structure, containers both with and without flanged upper edges may be securely engaged by the support bracket.

BRIEF DESCRIPTION OF THE DRAWINGS

These and other aspects of the invention will be better understood from the following detailed description of the preferred embodiments, with reference to the accompanying drawings in which:

FIG. 5 is a front elevational view of the support bracket shown in FIG. 4 and a salad bowl, in accordance with the present invention;

FIG. 6 is a perspective view of the support bracket shown in FIG. 4 and a baking dish, in accordance with the present invention;

FIG. 7 is a front elevational view of the support bracket and baking dish shown in FIG. 6; and FIG. 8 is a front elevational view of the support bracket shown in FIG. 4 and a serving platter, in accordance with the present invention.

DETAILED DESCRIPTION OF THE PREFERRED EMBODIMENTS

Within the drawings, like numerals correspond to like elements in the different figures.

Figure 1:
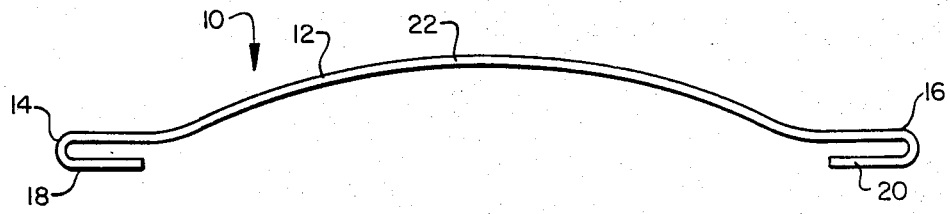
FIG. 1 is a front elevational view of the support bracket in accordance with one preferred embodiment of the present invention.

Referring first to FIG. 1, there is shown a support bracket 10 formed from a resilient material such as one-eighth inch thick metal wire or plastic 12. The wire may be round or in the form of a horizontally flat strip.

The wire 12 is bent downward and inward at opposite ends 14 and 16 to form U-shaped end portions 18 and 20, both lying in a same vertical plane for engaging opposite top edges of a baking dish or other container to be covered as will be described below.

Between the U-shaped end portions 18 and 20, wire 12 is bowed upward to form a resilient, elongated, generally horizontally extending bowed upward portion 22 for supporting a flexible sheet above the contents of the container as will be described above.

Figure 2:
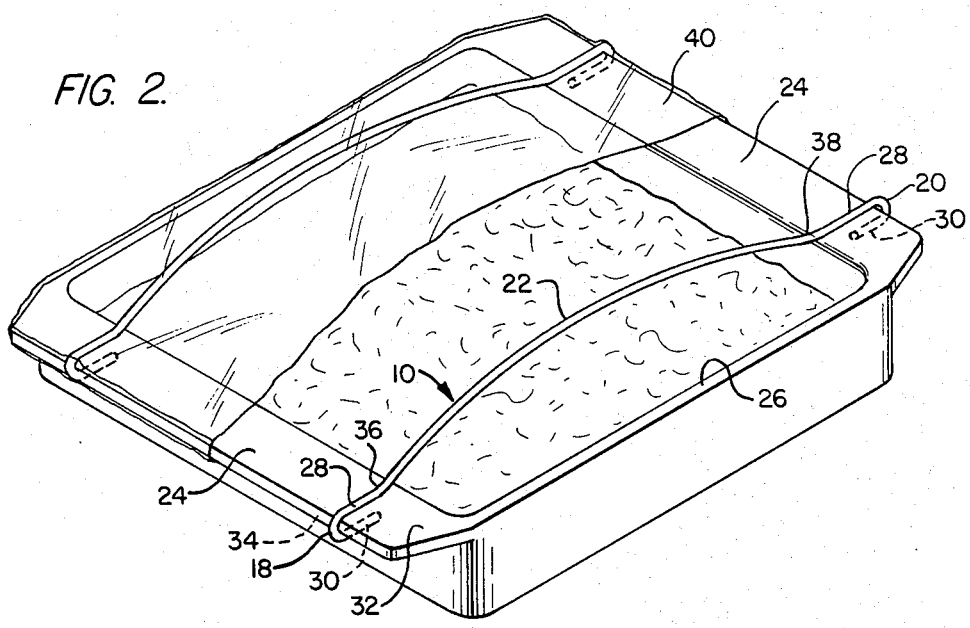
FIG. 2 is a perspective view of the support bracket shown in FIG. 1 and a baking dish and flexible sheet, in accordance with the present invention with a portion broken away for clarity.

Referring now to FIG. 2, it can be seen that the suppot bracket 10 slides onto horizontal flanges 24 of an appropriately sized baking dish 26 with the horizontal upper legs 28 and the horizontal lower legs 30 of the U-shaped end portions 18 and 20 respectively slidable along the upper surface 32 and lower surface 34 of flanges 24. In the event that the baking dish or other container is somewhat larger than as illustrated in FIG. 2, the bowed upward portion 22 is resilient and sufficiently flexible so that it may be partially flattened so that the support bracket 10 is horizontally lengthened, thereby permitting the U-shaped end portions 18 and 20 to engage the flanges 24 similarly as illustrated in FIG. 2.

Thus, the support bracket in accordance with the present invention is not limited in its use to only one size container. This adaptability of the support bracket 10 to a range of container sizes is facilitated by the curvature of the support bracket in the transition regions 36 and 38 respectively between U-shaped end portions 18 and 20 and the bowed upward portion 22, which have upward extending radii of curvature. This curvature permits the bowed upward portion 22 to be partially flattened without significantly affecting the shape and orientation of the U-shaped end portions or their effectiveness in engaging the container flanges 24.

Figure 3:
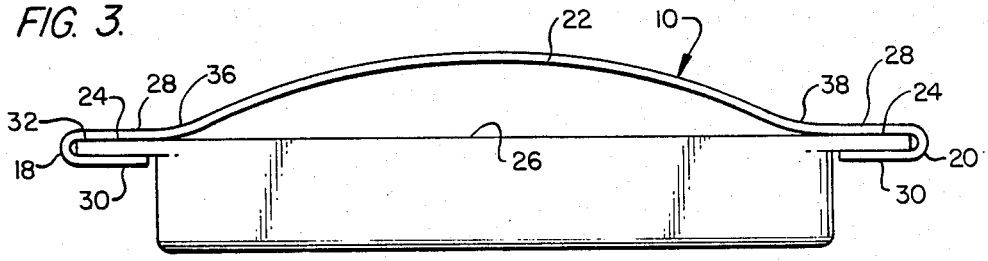
FIG. 3 is a front elevational view of the support bracket and baking dish shown in FIG. 2.

FIG. 3 illustrates the use of a pair of support brackets 10 on baking dish 26, supporting a plastic wrap 40 in vertically spaced relation to a food item within the container. This arrangement is particularly useful for rectangular baking dishes, where it is desirable to maintain a generally uniformly arched covering over the food in the direction of the parallel opposing side edges of the container.

Figure 4:
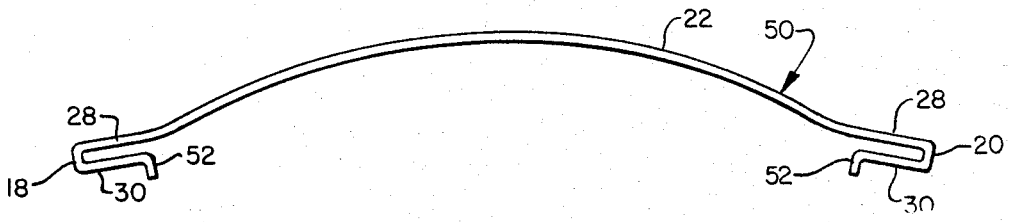
FIG. 4 is a front elevational view of a support bracket in accordance with a second embodiment of the present invention.

Referring now to FIG. 4, there is shown a support bracket 50 in accordance with a second embodiment of the invention. Support bracket 50 is substantially identical to support bracket 10 except for the provision of vertical legs 52 extending integrally downward from the inner ends of lower horizontal legs 30.

The provision of vertical legs 52 increases the versatility of the support bracket to permit its use for covering flangeless containers such as salad bowls as illustrated in FIG. 5 and baking dishes having flangeless side edges as illustrated in FIG. 6.

Referring to FIG. 7 which is a front elevational view of the support brackets and baking dish shown in FIG. 6, it can be seen that the vertical legs 52 engage the side walls 54 of the baking dish 56 under tension derived from the partially flattened bowed upward portion 22. Support bracket 50 is preferably formed from plastic or metal strip rather than a round wire in order to maximize the surface area of vertical leg 52 contacting the side walls of the container in order to maximize the vertical stability of the support bracket.

Support bracket 50 may also be used like support bracket 22, with containers having generally horizontal flanges at their outer peripheral edges, such as is illustrated in FIG. 8.

It will be appreciated by those of ordinary skill in the art to which the invention pertains that although a number of preferred embodiments of the invention have been hereinabove described, there are many modifications which may be made fully within the scope of the invention, which is limited only by the appended claims.

What is claimed is:

1. A support bracket for supporting a flexible sheet covering a container in spaced relation to the contents of the container, comprising:

an elongated resilient member generally extending in a horizontal direction, having U-shaped end portions for removably engaging opposite top edges of the container, and an elongated, generally horizontally extending bowed upward portion between said U-shaped end portions for supporting thereabove the flexible sheet.

2. A support bracket as in claim 1, wherein said U-shaped portions lie in a vertical plane so as to be engagable with the top and bottom surfaces of a generally horizontal flange of a container having a generally horizontal flange at the top edges thereof.

3. A support bracket as in claim 2, wherein said bowed upward portion is resilient and sufficiently flexible so as to be partially and resiliently flattenable so as to permit said U-shaped end portions to engage the top and bottom surfaces of generally horizontal flanges of a container having generally horizontal peripheral flanges having peripheral opposite top edges separated by more than the horizontal length of said support bracket.

4. A support bracket as in claim 3, wherein said elongated resilient member is formed from an elongated rod bent at opposite ends and curved between said opposite ends to respectively form said U-shaped end portions and said bowed upward portion, said U-shaped portions including horizontally extending upper legs respectively extending continuously into opposite ends of said bowed upward portion, said elongated rod having respective upward extending radii of curvature at the transitions between said upper legs and said bowed upward portion.

5. A support bracket as in claim 4, wherein said U-shaped end portions include horizontally extending lower legs below said upper legs for engaging the undersurface of a flange of the container.

6. A support bracket as in claim 5, further comprising vertical legs extending downwardly from inner ends of said lower legs for frictionally engaging the side walls of said container below the opposite top edges thereof.

7. A support bracket as in claim 3, wherein said elongated member comprises metal wire.

8. A support bracket as in claim 3, wherein said elongated member comprises plastic.

9. A support bracket as in claim 3, wherein said elongated member comprises an elongated strip.

10. A support bracket as in claim 3, wherein said U-shaped end portions are horizontally wider than said bowed upward portion.

11. An arrangement for covering a container in spaced relation to the contents thereof, comprising:

a. a flexible sheet; and b. an elongated resilient member generally extending in a horizontal direction, having:

(1) U-shaped end portions for engaging opposite top edges of the container, lying in a vertical plane; and (2) an elongated, generally horizontally extending resilient bowed upward portion formed between said U-shaped end portions for supporting thereabove said flexible sheet;

c. said bowed upward portion being resilient and sufficiently flexible so as to be partially and resiliently flattenable so as to permit said U-shaped end portions to engage the top and bottom surfaces of a generally horizontal flange of a container having a generally horizontal peripheral flange having peripheral opposite top edges separated by more than the horizontal length of said support bracket.

12. An arrangement as in claim 11, wherein said flexible sheet comprises a metal foil.

13. An arrangement as in claim 11, wherein said flexible sheet comprises polyethylene.

14. An arrangement for covering an item having a soft or sticky upper surface, comprising:

a. a container having an upper peripheral edge for holding the item to be covered;

b. a flexible sheet; and c. an elongated resilient member generally extending in a horizontal direction, having:

(1) U-shaped end portions for engaging opposite portions of said upper peripheral edge, lying in a horizontal plane; and (2) an elongated, generally horizontally extending resiliently flexible bowed upward portion formed between said U-shaped end portions for supporting thereabove said flexible sheet;

said upper peripheral edge being dimensioned so that when said U-shaped end portions engage said opposite portions of said upper peripheral edge of said container, said U-shaped end portions are urged inwardly by tension in said bowed upward portion, and said upward bowed portion is spaced from the upper surface of said item.

15. An arrangement as in claim 12, wherein said container comprises a baking dish.

16. An arrangement as in claim 13, wherein said baking dish has a peripheral horizontal flange at said upper peripheral edge and said U-shaped end portions engage the bottom surface of said flange when said U-shaped end portions engage said opposite portions of said upper peripheral edge of said container.

17. An arrangement as in claim 14, wherein said container comprises a food dish having a generally vertical peripheral side wall, each of said U-shaped end portions include connected horizontally extending upper and lower legs and a vertical leg extending downwardly from the innermost ends of said lower leg for frictionally engaging the side wall of said container adjacent said upper peripheral edge thereof.

18. An arrangement as in claim 17, wherein said food dish comprises a salad bowl.

19. An arrangement as in claim 14, wherein said container comprises a food platter, said food platter having a peripheral horizontal flange at said upper peripheral edge and said U-shaped end portions engage the bottom surface of said flange when said U-shaped end portions engage said opposite portions of said upper peripheral edge of said container.

20. An arrangement for covering an item having a soft or sticky upper surface with a flexible sheet, comprising:

a. a container having parallel opposing upper peripheral edges, for holding the item to be covered by the flexible sheet, said container including horizontal flanges extending along said upper peripheral edges; and b. an elongated resilient member generally extending in a horizontal direction, having:

(1) U-shaped end portions for engaging opposite portions of said upper peripheral edge, lying in a horizontal plane; and (2) an elongated, generally horizontally extending resilient bowed upward portion formed between said U-shaped end portions for supporting thereabove the flexible sheet;

c. the distance between said opposite portions of said upper peripheral edge of said container being such that said U-shaped end portions are slidable along said flanges to locate said support bracket over the contents of said container.

21. An arrangement as in claim 10, wherein said container includes two opposing elongated upper edges, said elongated resilient member being a first resilient member, said arrangement further comprising a second elongated resilient member substantially identical to said first elongated resilient member, whereby when first and second elongated resilient members are arranged in parallel spaced relation with their U-shaped end portions engaging said opposing elongated upper edges, the bowed upward portions of said first and second elongated resilient members can support the flexible sheet thereabove in a generally uniformly arched shape along the direction of said two opposing elongated upper edges of said container.

* * * * *